United States Patent [19]

Kümmerling et al.

[11] 4,408,477

[45] Oct. 11, 1983

[54] ADJUSTABLE PRESS TOOL

[75] Inventors: Rolf Kümmerling, Essen; Robert Poos, Grevenbroich; Thomas Pentzien, Duisburg; Karl-Heinz Papierok, Essen, all of Fed. Rep. of Germany

[73] Assignee: Mannesmann Aktiengesellschaft, Düsseldorf, Fed. Rep. of Germany

[21] Appl. No.: 406,529

[22] Filed: Aug. 9, 1982

[30] Foreign Application Priority Data

Aug. 19, 1981 [DE] Fed. Rep. of Germany ..... 3133178

[51] Int. Cl.[3] ..... B21D 37/02

[52] U.S. Cl. ..... 72/478; 72/368; 72/389; 72/413

[58] Field of Search ..... 72/478, 389, 386, 412, 72/413, 367, 368

[56] References Cited

U.S. PATENT DOCUMENTS

| | | | |
|---|---|---|---|
| 652,658 | 6/1900 | Bishoff | 72/368 |
| 1,202,775 | 10/1916 | Barr | 72/478 |
| 3,802,239 | 4/1974 | Karmann | 72/368 |
| 4,294,095 | 10/1981 | Kawano | 72/368 |

FOREIGN PATENT DOCUMENTS

| | | | |
|---|---|---|---|
| 53-65250 | 6/1978 | Japan | 72/413 |

*Primary Examiner*—Gene Crosby

*Attorney, Agent, or Firm*—Ralf H. Siegemund

[57] ABSTRACT

The press tool as disclosed is provided for making tubes or pipes at a diameter of 600 millimeters or more and a diameter-to-wall-thickness ratio of 13 or more. In order to permit employment of the tool for a relatively wide range of dimensions without requiring extensive retooling, it is suggested that the tool is comprised of a stationary centerpiece and side pieces, which are hinged to the centerpiece and held in position by spacer bars acting as adjustable cams.

3 Claims, 2 Drawing Figures

6
5
15
44
51
43
42
4
52
5b
3
13
2
1
11
4'
51
41
42'
32
31
3'
5a
13'
2

A
B
44
5
43
42
5'
4
13
3
1
2
13'
5a
2
11

ADJUSTABLE PRESS TOOL

BACKGROUND OF THE INVENTION

The present invention relates to an adjustable press-working tool of overall U-shaped configuration, as far as its outer working contour is concerned, and provided for purposes of making tubes and pipes of a large diameter, such as tubes having a diameter of 600 millimeters or more and a diameter-to-wall-thickness ratio of 13 and more.

Large tubes of different materials and in different dimensions are made in one and the same U-press into which different tools are inserted for accommodating the process tool to different materials, and different dimensions of the tube or pipe to be made.

It was found that maintaining an inventory and refitting the press by using different tools from the inventory is quite expensive and time-consuming. This becomes the more noteworthy when, for example, just the wall thickness or the material changes, even though the diameter of the tube to be made is not changed; one may still have to change the immediate press tool.

DESCRIPTION OF THE INVENTION

It is an object of the present invention to provide a new and improved U-shaped press-working tool for the making of tubes and pipes of a relatively large diameter, which tool is adjustable so that the same tool can be used for a wide range of different diameters and/or different wall thicknesses and/or different materials.

In accordance with the preferred embodiment of the present invention, it is suggested to provide such a tool by using, so to speak, as a core a stationary centerpiece with arcuate and convexly curved outer working surface and having a radially inwardly arranged mounting structure; a pair of symmetrically contoured side pieces with generally convex working surfaces are hinged individually to the mounting structure, permitting basically a certain angular range to be covered by pivoting about the respective hinge axes; a pair of spacer bars is provided, each having different cam surfaces, and the bars are interposed between the side pieces and the mounting structure, but at a point offset from the hinge axes in order to establish and maintain particular angular positions for the side pieces; the angular positions are changed by axially changing the position of the spacer bars so that different cam surfaces are being used. The adjustment may be carried out in steps with different angular positions as between the two side pieces, differing in certain steps until 30° on each side.

It was found that the tool constructed in accordance with the invention uses for tube-making press tools an inventory which is reduced to a very considerable extent. Also, refitting the equipment is required, on the average, less frequently, and the requisite effort is reduced because the adjustment of the tool to different pipe-making conditions is quite simple; it involves merely shifting these spacer bars and establishing different hinge positions and orientations for the side pieces.

It was found particularly that different wall thicknesses and different materials can very easily be accommodated by this simple adjustment.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, the tool depicted therein includes a central and lower part 1 of arcuate configuration, covering a limited angular range and being suspended from a central bar 11 being welded thereto and on the inside of the curvature. The central tool part 1 includes further two flat, contoured pieces 5 and 5', also welded to the parts 1 and 11. These side pieces 5 and 5' have each abutment edges **5*a* and 5*b* on opposite sides. Moreover, the two pieces 5 and 5' have a central receiving opening of a round configuration with a narrower entrance slot for ongitudinal insertion of a receiver 6** by means of which the tool is suspended and otherwise positioned.

Figure 2:
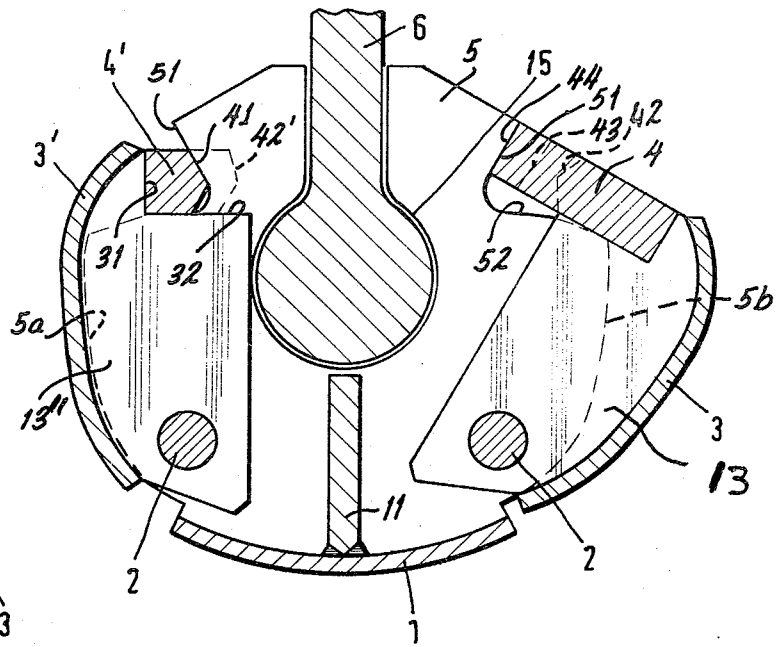
FIG. 2 is a section view taken along line A-B in FIG. 1.
Figure 1:
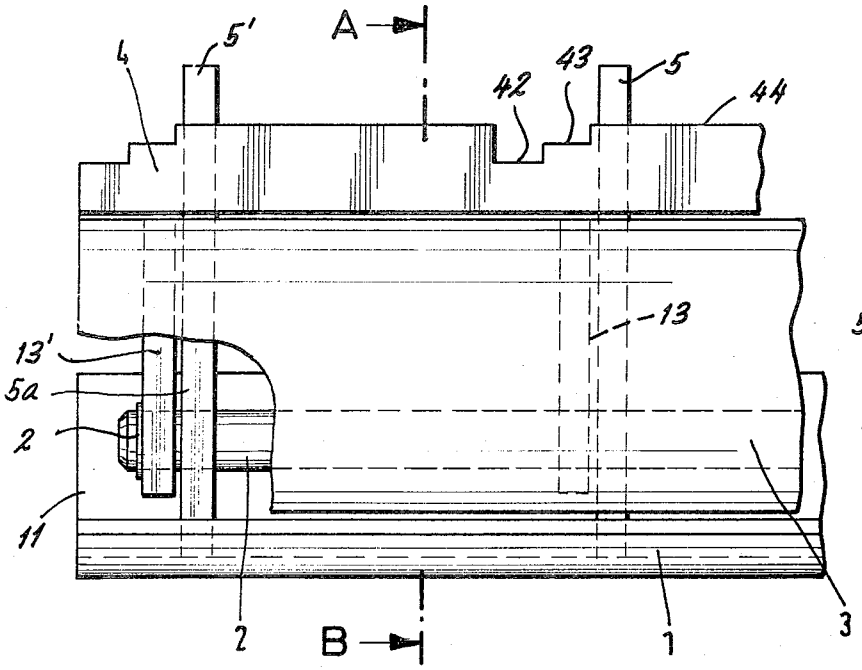
FIG. 1 is a side view of the tool in accordance with the preferred embodiment of the present invention for practicing the best mode thereof.

The tool further includes two side pieces 3 and 3' for completing the two-tube-making tool together with the central part 1. Each one of these side pieces 3 and 3' is provided with a pair of holding elements, such as 13 and 13' for side piece 3 and another one for side piece 3'. These holding pieces each are particularly contoured, which includes particularly shaped indents bounded by two ledges 31 and 32, arranged at right angles to each other. As will be explained shortly, the ledges cooperate with ledges bounding indents in the plates 5 and 5'. The ledges are identified by reference numerals 51 and 52, each pair defining one of these indents, and they are oriented to each other, for example, at 60°. The several ledges will abut particular camming surfaces of spacer bars, such as 4 and 4', illustrated here for purposes of variety in two different configurations. The spacer bar 4 has a number of notches, respectively defining abutment surfaces, for example 42 and 43. The bar 4' is shown to have two such camming surfaces, one has been identified by 42' and having an orientation analogous to the orientation of camming surface 42. In addition, the bar 4' shows another Camming surface 41. These camming surfaces can be seen in Steps in FIG. 1 and occur in each bar in pairs because they will cooperate with the plates 5 and 5', and here particularly with a ledge surface 51 in each instance. The corner of a spacer bar, such as 4 or 4' opposite the several camming surfaces, is placed in abutment with the right angle ledge surfaces 31 and 32 of the holding plates, such as 13, on which the side pieces of the tool, such as 3', are mounted. Furthermore, it will be noted that side piece 3', through its two holding plates 13 and 13', is mounted on a journal axle 2 for pivoting about this axle, and another one mounting the other working side 3'. These axles 2 and 2' are otherwise held in the plates 5 and 5'.

It can thus be seen that for different axial positions of two spacer and camming bars 4 (or two bars 4'), the side pieces 3 and 3' of the tool are angularly adjusted and positioned. Moreover, the different camming positions establish a variety of operating positions for the tool pieces 3 and 3'. It should be mentioned further that the side pieces 3 and 3', one of their respective holding plates (13 or 13'', etc.) may for example be slightly spring-biased toward a minimum inclination in order to prevent these pieces from falling down. The sides may, in the alternative, be held and positioned hydraulically. During working, of course, the forces acting on the tool are radially inwardly directed and are taken up by the plates 13, etc., by the bars such as 4 or 4', and by the plates 5 and 5' reacting into the holding and suspension structure 6.

The inventon is not limited to the embodiments described above; but all changes and modifications thereof, not constituting departures from the spirit and scope of the invention, are intended to be included.

We claim:

1. A press-working tool with a generally U-shaped contour for making tubes or pipes of a relatively large diameter, such as 600 millimeters and larger, at a diameter-to-wall-thickness ratio of approximately 13 and larger, comprising:

an arcuate centerpiece having an outwardly oriented convex working surface and a radially inwardly arranged mounting structures;

a pair of symmetrically contoured side pieces with generally convex working surfaces, being hinged to the mounting structure; and a pair of spacer bars having different cam positions and being interposed between the side pieces and the mounting structure to establish a particular angular position for the side pieces.

2. The tool as in claim 1, the side pieces being hinged adjacent to the working surface on the inside.

3. The tool as in claim 1 or 2, the spacer bars having a cam-like configuration of stepped contour, different axial positions establishing different angular positions for the side pieces.

* * * * *